US006889023B2

(12) United States Patent
Suda et al.

(10) Patent No.: US 6,889,023 B2
(45) Date of Patent: May 3, 2005

(54) CHARGING DEVICE, PROCESS CARTRIDGE AND IMAGE FORMING DEVICE

(75) Inventors: Takeo Suda, Tokyo (JP); Hirohmi Harada, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 10/226,148

(22) Filed: Aug. 23, 2002

(65) Prior Publication Data

US 2003/0123905 A1 Jul. 3, 2003

(30) Foreign Application Priority Data

Aug. 24, 2001 (JP) ..... 2001-255120
Sep. 14, 2001 (JP) ..... 2001-279137

(51) Int. Cl.[7] ..... G03G 15/02
(52) U.S. Cl. ..... 399/176
(58) Field of Search ..... 399/174, 176, 399/168; 492/18, 56, 27, 59; 361/225

(56) References Cited

U.S. PATENT DOCUMENTS 4,461,663 A * 7/1984 Tachibana et al. ..... 156/86
5,486,906 A * 1/1996 Tsuneeda et al. ..... 399/174
5,532,795 A 7/1996 Tatsumi et al.
5,534,344 A * 7/1996 Kisu et al. ..... 428/323
5,567,494 A * 10/1996 Ageishi et al. ..... 428/36.9
5,678,125 A 10/1997 Kutsuwada et al.
5,815,767 A 9/1998 Kutsuwada et al.
5,851,657 A * 12/1998 Yasuno et al. ..... 428/332
5,887,224 A 3/1999 Mizuishi et al.
5,915,143 A 6/1999 Watanabe et al.
5,999,776 A * 12/1999 Abe et al. ..... 399/176
6,006,050 A 12/1999 Watanabe et al.
6,055,388 A 4/2000 Watanabe et al.
6,055,394 A 4/2000 Suda et al.
6,097,914 A 8/2000 Tanaka et al.
6,101,351 A 8/2000 Suda et al.
6,173,143 B1 * 1/2001 Hirota et al. ..... 399/176
6,256,465 B1 7/2001 Yoshinaga et al.
6,336,013 B1 1/2002 Suda et al.
6,381,432 B1 * 4/2002 Hattori ..... 399/176
6,463,237 B2 10/2002 Suda et al.
6,560,414 B2 5/2003 Suda et al.

FOREIGN PATENT DOCUMENTS

JP 7-244417 9/1995
JP 09011362 A * 1/1997 ..... B29D/31/00
JP 09160352 A * 6/1997 ..... G03G/15/02
JP 10-48910 2/1998
JP 2000-75601 3/2000

* cited by examiner

*Primary Examiner*—Robert Beatty
(74) *Attorney, Agent, or Firm*—Oblon, Spivak, McClelland, Maier & Neustadt, P.C.

(57) ABSTRACT

A charging unit, used for an image forming device, is provided, which comprises a conductive base, and a single-layered resistant layer, covering on a surface of the conductive base. The charging unit is in contact with an electrified body, and by applying a voltage to the conductive base, a charging process is performed in a contact charging manner. Furthermore, the single-layered resistant layer has a thickness equal to or below 0.7 mm, and has a surface resistance between $1\times10^3$ (Ω/□) and $1\times10^{15}$ (Ω/□). Therefore, a charging roller can be made with a very simple structure of the single-layered resistant layer surrounding the core metal, so that a cheap conductive roller can be provided. In addition, the charging unit can be spaced from the electrified body by a small gap and the resistant layer can include nylon.

36 Claims, 9 Drawing Sheets

| Surface resistance (Ω/□) | Thickness (mm) | AC current (mA) | | | | | | | | | | | |
|---|---|---|---|---|---|---|---|---|---|---|---|---|---|
| | | 0.5 | 0.6 | 0.7 | 0.8 | 0.9 | 1.0 | 1.1 | 1.2 | 1.3 | 1.4 | 1.5 | 1.6 |
| 1.00E+01 | 0.03 | × | × | × | × | × | × | × | × | ○ | ○ | ○ | ○ |
| | 0.2 | × | × | × | × | × | × | × | ○ | ○ | ○ | ○ | ○ |
| | 0.7 | × | × | × | × | × | × | × | ○ | ○ | ○ | ○ | ○ |
| 1.00E+03 | 0.03 | × | × | × | × | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | ○ | ○ | ○ | ○ | ○ | ○ | ○ |
| 1.00E+05 | 0.03 | × | × | × | × | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | ○ | ○ | ○ | ○ | ○ | ○ | ○ |
| 1.00E+10 | 0.03 | × | × | × | ○ | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | × | ○ | ○ | ○ | ○ | ○ | ○ |
| 1.00E+15 | 0.03 | × | × | × | ○ | ○ | ○ | ○ | ○ | ○ | ○ | ○ | ○ |
| | 0.2 | × | × | × | × | × | × | × | ○ | ○ | ○ | ○ | ○ |
| | 0.7 | × | × | × | × | × | × | × | × | × | × | ○ | ○ |
| 1.00E+20 | 0.03 | × | × | × | × | × | × | △ | △ | △ | △ | △ | △ |
| | 0.2 | × | × | × | × | × | × | × | × | × | × | △ | △ |
| | 0.7 | × | × | × | × | × | × | × | × | × | × | × | △ |

FIG. 4

| Surface resistance (Ω/□) | Thickness (mm) | AC current (mA) | | | | | | | | | | | |
|---|---|---|---|---|---|---|---|---|---|---|---|---|---|
| | | 0.5 | 0.6 | 0.7 | 0.8 | 0.9 | 1.0 | 1.1 | 1.2 | 1.3 | 1.4 | 1.5 | 1.6 |
| 1.00E+01 | 0.03 | × | × | × | × | × | × | × | × | ○ | ○ | ○ | ○ |
| | 0.2 | × | × | × | × | × | × | × | ○ | ○ | ○ | ○ | ○ |
| | 0.7 | × | × | × | × | × | × | × | ○ | ○ | ○ | ○ | ○ |
| 1.00E+03 | 0.03 | × | × | × | × | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | ○ | ○ | ○ | ○ | ○ | ○ | ○ |
| 1.00E+05 | 0.03 | × | × | × | × | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | ○ | ○ | ○ | ○ | ○ | ○ | ○ |
| 1.00E+10 | 0.03 | × | × | × | ○ | ○ | ○ | ○ | ○ | ○ | ○ | ○ | ○ |
| | 0.2 | × | × | × | × | ○ | ○ | ○ | ○ | ○ | ○ | ○ | ○ |
| | 0.7 | × | × | × | × | × | × | ○ | ○ | ○ | ○ | ○ | ○ |
| 1.00E+15 | 0.03 | × | × | × | ○ | ○ | ○ | ○ | ○ | ○ | ○ | ○ | ○ |
| | 0.2 | × | × | × | × | × | × | ○ | ○ | ○ | ○ | ○ | ○ |
| | 0.7 | × | × | × | × | × | × | × | ○ | ○ | ○ | ○ | ○ |
| 1.00E+20 | 0.03 | × | × | × | × | × | × | ○ | ○ | ○ | ○ | ○ | ○ |
| | 0.2 | × | × | × | × | × | × | × | × | × | × | ○ | ○ |
| | 0.7 | × | × | × | × | × | × | × | × | × | × | × | ○ |

FIG. 13

CHARGING DEVICE, PROCESS CARTRIDGE AND IMAGE FORMING DEVICE

CROSS-REFERENCE TO RELATED APPLICATION

This application claims the priority benefit of Japanese application serial no. 2001-255120, filed on Aug. 24, 2001 and 2001-279137, filed on Sep. 14, 2001.

BACKGROUND OF THE INVENTION

1. Field of the Invention

This invention relates in general to an improvement of a charging roller used in an image forming device such as a copy machine, a printer, a facsimile device etc. using an electronic photographic process. More particular, the invention relates to a charging roller, which has a better productivity due to its simple structure and having an excellent recycling ability.

2. Description of Related Art

In an electronic photographic type image forming device, a photoreceptor is charged by a charging device such as a charging roller, and then by exposing the photoreceptor's surface, an electrostatic latent image is obtained. After the electrostatic latent image is developed by the toner provided from a developing device to a toner image, the toner image is transferred onto a transfer paper. Then, an image is thus formed after a fixing process is performed.

In recent years, in view of environmental concerns, a charging device for a photoreceptor or a paper transfer device, which adopts a so-called contact charging type so that only a little amount of ozone is generated, has become a main product. Japanese Patent No. 3100625 discloses a charging material used in the above charging device. A multi-layered charging roller is of a general type with a structure such that a coating layer is coated on an intermediate layer with elasticity and conductivity surrounding a metal shaft of good conductor. When the contact charging process is executed on an electrified body such as the photoreceptor, if the straightness of the charging roller's edge line is not good, the contact state with the electrified body in the generating line direction of the charging roller becomes uneven. Because a poor electrification might occur, in general, the surface of the intermediate layer, which has elasticity and conductivity and is formed by rubber or foam, is ground to obtain a good straightness. This grinding operation is repeatedly performed in an order of a rough grinding, a medium grinding and a finishing grinding.

In addition, in the actual process, the metal shaft protruding form the two ends of the roller in the axial direction is kept rotatable. Mostly, the roller is rotated and a grinding stone is moved to press and contact with the roller, so as to grind the roller. Therefore, the slipping amount of the roller due to the grinding stone's press contact force is different at the roller's end and at the roller's central portion, and therefore, deviation between the grinding amounts at the roller's end and at the roller's central portion occurs easily. In addition, the grinding amount is smaller than the target value, and the grounded dimension becomes large, which causes a bounce phenomenon.

To prevent the aforementioned problem, the press contact forces respectively applied to the roller's end and central portion are changed, the grinding process is performed plural times, and each time only a little amount is grounded.

Therefore, the manufacturing time is increased, and the device inevitably costs more. The roller's shape cannot be completely controlled, causing a drawback of the roller having an uneven shape.

In Japanese Laid Open No. H05-307279, when the above charging roller is used to charge in a non-contact manner, an air gap below 120 $\mu$m is required. Because the roller shape's unevenness is increased in the grinding process, it is very difficult to maintain the air gap below 120 $\mu$m across the longitudinal direction of the roller. In addition, even though the air gap can be maintained within 120 $\mu$m, charging unevenness might occur due to much gap unevenness. In order to reduce the charging unevenness, increasing the accuracy in the longitudinal direction of the roller is required, so that the grinding process has to be performed much more. Therefore, the manufacturing cost is increased.

In addition, in order to make the charging roller to be in contact with the electrified body firmly and to be driven by an accompanying rotation with the electrified body, in general, the charging roller uses a resilient unit such as a spring with a preset press pressure to press and contact with the electrified body. In this case, a press force is applied by a spring etc, to the two ends of the charging roller in the axial direction, and the charging roller's central portion in the axial direction is warped to a direction deviating from the electrified body. In order to avoid the above problem, the metal shaft (as the core metal of the charging roller) is thickened to increase the rigidity etc., but problems, such as high cost and heavy weight, may occur.

On the other hand, Japanese Laid Open No. 64-73365 discloses a charging roller with a structure such that a single-layered conductive resistant layer is covered surrounding a metal shaft of good conductor. However, similar to the aforementioned charging roller, a grinding process is also required. Therefore, the cost is high and the shape unevenness is great. Additionally, in view of contamination to the electrified body (the photoreceptor), a structure without the coating layer on the roller's surface is not practical. Furthermore, the conventional conductive unit has a rubber layer formed on the outer circumferential surface. When reusing the conductive base, removing the rubber layer is a time-consuming job, and therefore, the reproducing cost is increased.

Recently, from the environmental viewpoint, it has become desirable to make good products capable of being recycled. The part design capable of reuse becomes a portion of the material recycled. In consideration of recycling, the conventional conductive unit has a structure such that a low friction material is covered on the roller's surface. When the roller's surface is contaminated due to long time use, the contamination can be easily removed by washing and cleaning, so that reuse is possible. However, when there occurs physical defects such as pinholes or cracks, since the roller is fixed by adhesive, replacing the roller needs time and therefore the cost increases. In this case, the reuse is impossible and as a result, the conductive unit is wasted.

SUMMARY OF THE INVENTION

According to the foregoing description, it is an object of the present invention to provide a conductive roller (a charging roller), which has a simple structure and is cheap because of a simple method of production such that a thin film tube is covered around a core metal of the conductive roller.

It is still another object of the present invention to provide a cheap conductive unit, and also to provide a charging device, a process cartridge and an image forming device using the charging unit.

According to the object(s) mentioned above, the present invention provides a conductive unit, used for an image forming device, comprising a conductive base, and a single-layered resistant layer, covering a surface of the conductive base. The conductive unit is in contact with an electrified body, and by applying a voltage to the conductive base, a charging process is performed in a contact charging manner. Preferably, the single-layered resistant layer has a thickness equal to or below 0.7 mm, and has a surface resistance between $1\times10^3$ (Ω/□) and $1\times10^{15}$ (Ω/□).

The above single-layered resistant layer can be made of a tube with a preset thickness, and the tube covers the conductive base. The single-layered resistant layer made of the tube can be fixed onto the conductive base by a thermal contraction. In addition, a taper portion can be formed so at least one end of the conductive base is covered by the tube that forms the single-layered resistant layer.

The invention further provides an image forming device, which comprises at least a process cartridge, having a conductive unit as described above therein.

The invention further provides an image forming device, which comprises the aforementioned charging unit. A bias applied to the conductive unit includes an AC bias and a DC bias.

The invention further provides a charging unit, for an image forming device, comprising a base, whose surface is a good conductor, and a resistant layer, covering over the base. The charging unit keeps a sufficiently small gap with an electrified body, and is used for charging a surface of the electrified body uniformly due to a discharge at the gap.

In the above charging unit, the resistant layer can be a multi-layered structure. The resistant layer is covered over the base after the resistant layer is formed in a tube shape with a preset thickness. The tube-shaped resistant layer is fixed onto the base by a thermal contraction.

In addition, an adhesive can be used between the resistant layer and the base, or between layers of the resistant layer. The surface resistance of the resistant layer is equal to or below 1015Ω/□. The base material of the resistant layer is nylon, and comprises a low fiction material. Moreover, the resistant layer is made of PFA.

According to one aspect of the invention, a tap is formed on a portion of the resistant layer, and a gap can be cut out to form in the vicinity of the tap. Furthermore, a mark for indicating a stripping direction of the tap is formed on the tap, wherein the mark is colored different from the resistant layer.

The base is hollow, and a portion of the charging unit for charging is a cylindrical shape, and rotates accompanying the electrified body. A taper-shaped portion is formed on at least one end of the base. The taper-shaped portion is a curve whose profile between the taper-shaped portion and a portion near the base central side is convex outwards.

The invention further provides a charging device, which uses the charging unit as described above. For charging, an AC and a DC source are overlapped to provide the charging unit, or a DC source is provided to the charging unit.

The invention further provides a process cartridge, which uses the charging unit or the charging device as described above, built in the process cartridge.

The invention further provides an image forming device, which is equipped with the charging unit, the charging device, or the process cartridge as described above.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIG. 4 shows a result to verify the image by using rollers varying the surface resistance of the tube material;

FIG. 13 shows a result to verify the image by using the charging rollers varying the surface resistance of the tube material.

DESCRIPTION OF THE PREFERRED EMBODIMENT

The detail description according to the preferred embodiments of the present invention is made with references to the accompanying drawings. The following description is an example of a charging device for a photoreceptor in an image forming device according to the present invention, but does not limit the scope of the present invention.

Figure 1:
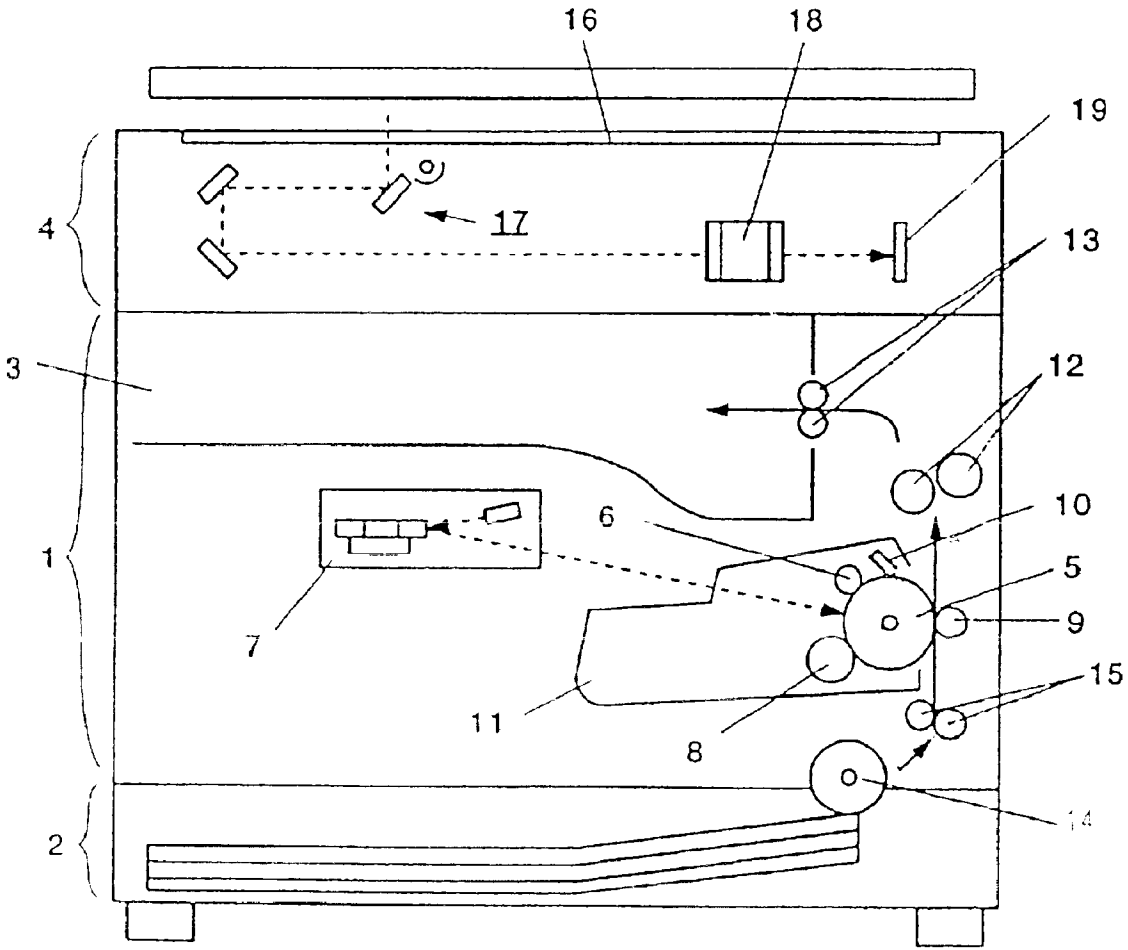
FIG. 1 is a schematic cross-sectional view showing the entire structure of an image forming device according to the invention.

FIG. 1 is a schematic cross-sectional view showing the entire structure of an image forming device according to the invention. Because the image forming device shown in FIG. 1 is a type that stores the printed documents in paper ejection storage section 3, the image forming section 1 is substantially arranged at the center and a feeding unit 2 is arranged right under the image forming section 1. If necessary, an additional paper feeding unit can be further arranged under the paper feeding unit 2. A reading section 4 for reading a document is disposed above the image forming section 1 through a paper ejection storage section 3. The paper ejection storage section 3 is a space between the reading section 4 and the image forming section 1, and is used for ejecting and storing the recording medium have an image formed thereon.

Within the image forming section 1, the following devices are respectfully disposed at locations surrounding the drumshaped photoreceptor 5: a charging device 6 for charging the photoreceptor 5's surface, and exposure device 7 for irradiating an image information by a laser beam onto the photoreceptor 5's surface, a developing device 8 for visualizing an electrostatic latent image that is formed by exposing the photoreceptor 5's surface, a transfer device 9 for transferring a toner image, which is developed on the photoreceptor 5's surface, onto a transfer paper, and cleaning device 10 for removing and recycling the residual toner on the photoreceptor 5's surface after transfer. In recent years, for easy maintenance, the photoreceptor 5, the charging device 6, the developing device 8 and the cleaning device 10 etc., are integrated into a single unit to serve as the process cartridge 11. A fixing device 12, which is used for fixing toner on the transfer paper having a toner image thereon, is disposed at a downstream side of the paper carrying passage. The transfer paper passing through the fixing device 12 is ejected by ejecting rollers 13 and then stored in paper ejection storage section 3.

The paper feeding unit 2 stores non-used papers. The upmost paper is sent out from the paper feeding unit (paper feeding cassette) 2 due to the rotation of the paper feeding roller 14, and then carried to the resist rollers 15. Under control, the resist roller 15 stops the transfer of the paper temporally, and then begins to rotate at a timing when a position relationship between the toner image on the photoreceptor 5 and the tip of the transfer reaches a preset position.

In the reading section 4, in order to read and scan a document (not shown) placed on a contact glass 16, a reading and scanning device 17 composed of a document irradiating light source and mirrors is moved back and forth. The image information scanned by the reading and scanning device 17 is read as an image signal and input to a CCD 19 that is disposed at a position behind the lens 18. The read image signal is digitized by an image process. According to the processed image signal, a laser diode (not shown) of the exposure device 7 irradiates to form the electrostatic latent image on the photoreceptor 5's surface by an exposure process. The light signal from the laser diode can be irradiated to the photoreceptor 5 through the well-known polygon mirror or lens.

Figure 2:
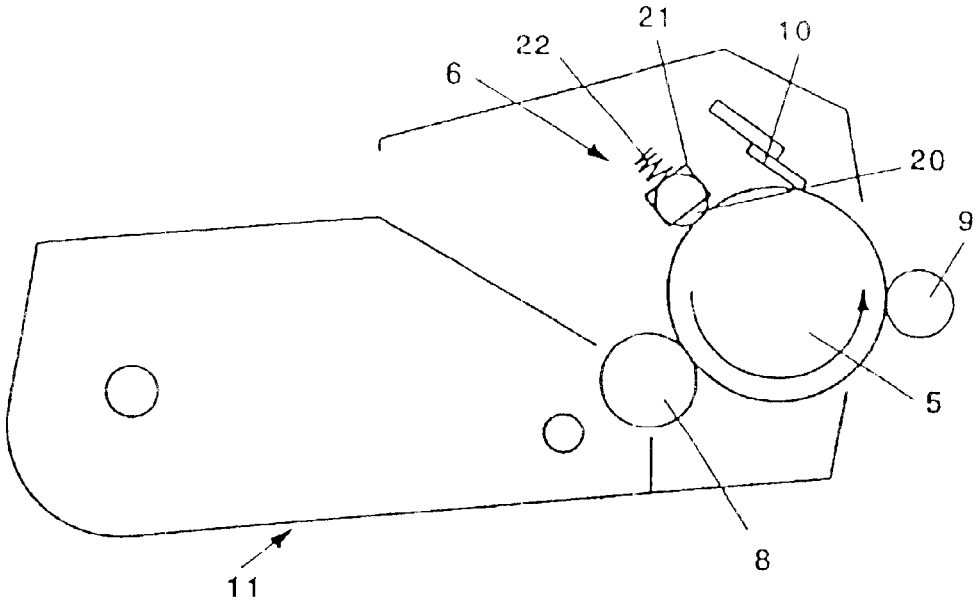
FIG. 2 is a schematic cross-sectional view for describing the charging device in detail.

FIG. 2 is a schematic cross-sectional view for describing the charging device in detail. In FIG. 2, the charging unit 20 is one of the parts of the charging device 6 disposed in the process cartridge 11. The two ends of the charging unit 20 are supported by bearings 21, and the charging unit 20 is pressed by springs 22 with a preset pressure to be in contact with the photoreceptor 5.

The charging unit 20 is a cylindrical shape. As the photoreceptor 5 rotates, the charging unit 20 is driven due to a frictional force at a contact portion, i.e., an accompanying rotation. The charging unit 20's press contact force against the photoreceptor 5 is set the smaller the better within a range where the accompanying rotation can occur. When the press pressure of the spring 71 is too strong, the two ends of the roller become fulcrums. Therefore, the charging roller 36's central portion in the axial direction is warped to a direction deviating from the photoreceptor 35, and poor electrification occurs easily.

Figure 3:
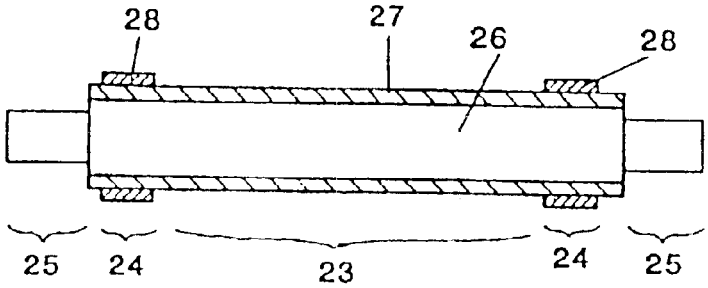
FIG. 3 is a schematic cross-sectional view showing the structure of the charging unit 20.

FIG. 3 is a schematic cross-sectional view showing the structure of the charging unit 20. The charging unit 20 is substantially a cylindrical shape and is composed of an image forming section 23, supporting sections 24, and a shaft 25. Regarding the image forming section 23, a thin tube 27 is covered on the surface of a base 26 of a good conductor such as stainless steel, and then spacers 28 used as the supporting sections 24 are attached onto the two ends of the image forming section 23. The thin tube 27 is made by pushing out or drawing, and is fixed to the base by heating and contracting after the thin tube 27 is covered on the base 26.

The material for the tube-shaped resistant layer 27 can be nylon, and perfluoroaloxy (PFA). Rollers are made by varying the thickness and the surface resistance of the thin tube 27 to verify the image charging quality. The experimental result is shown in FIG. 4. During the entire experiments in FIG. 4, the common conditions are as follows. The good conductive base is made of stainless steel (Japanese Industrial Standard type SUS, having a diameter of 14 mm at the center and 8 mm at the end), the material for the tube-shaped resistant layer 27 comprises carbon black, the power source has a voltage of DC−700V and an AC frequency of 1 kHz, and the press force of the roller is 400 gf (200 gf for each single side). In FIG. 4, the symbol "x" indicates that poor electrification occurs, the symbol "Δ" indicates uneven electrification, and the symbol "o" indicates that poor electrification does not occur.

As the AC bias applied to the charging roller 6 becomes larger, discharge products stuck onto the photoreceptor 5 (as an electrified object) increase much more. Under this influence, it is very clear that image deflections will occur. Empirically, it is preferable to set the AC bias equal to or below about 1.4 mA. In addition, if an output accuracy of the bias supply source to the charging roller 6 can be roughly designed without creating an abnormal image, a wider AC current range is preferable.

According to the result shown in FIG. 4, it can be understood that a very high AC current is required when the surface resistance is $1\times10^{20}$ (Ω/□,□ indicates $cm^2$). Additionally, because the output image may be uneven if the AC current is increased to charge, it is preferable that the surface resistance of the charging unit is below $1\times10^{15}$ (Ω/□). Furthermore, if the surface resistance is above $1\times10^{3}$ (Ω/□), a higher AC current is required as the thickness becomes larger. For the surface resistance of $1\times10^{15}$ (Ω/□), because the AC current has to be above 1.5 mA as the thickness exceeds 0.7 mm, it is preferable that the thickness is below 0.7 mm. Considering the output accuracy of the bias supply source, it is preferable that the surface resistance is between $1\times10^{3}$ (Ω/□)~$1\times10^{15}$ (Ω/□) and the thickness is below 0.7 mm.

Figure 5:
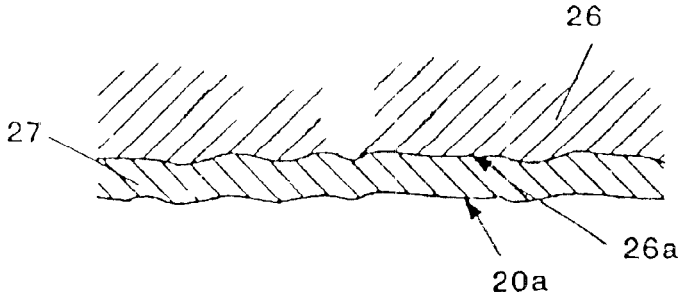
FIG. 5 is an enlarged diagram showing that the surface shape of the charging unit imitates the base's surface shape.

In this embodiment, a resistant layer is formed by the thin tube 27. As shown in FIG. 5, when this method is adopted, the surface profile 20*a* of the conductive unit 20 imitates the surface profile 26*a* of the base 26. Because the base 26 is made of a rigid body such as stainless steel that can keep a straightness of 1/1000~1/100, the grinding process for obtaining a dimensional accuracy in the conventional way is not necessary. Therefore, a very cheap conductive roller can be obtained.

The resistant layer made of the thin tube is a single-layered structure in this embodiment. However, the tube can be also a multi-layered structure because of a reason to possess a voltage endurance. A coating process can be performed if layers can be uniformly coated. Furthermore, the nylon and the PFA are used as the tube 27's material, but the resistant stability between the nylon and the rod is excellent and there is no such problem as contaminating the photoreceptor, i.e., the electrified body. On the other hand, for the PFA, foreign matters are difficult to stick on its surface in comparison with the nylon, and therefore, even though being used for a long time, the increase of the charging roller's resistance caused by the sticking of foreign matters does not occur. Furthermore, not only can a stable property can be achieved, but also a mechanism for cleaning the charging roller's surface is not required. Therefore, the device cost can be reduced.

Although the tube is fixed by a thermal contracting force, the thin film tube 27 can be also firmly fixed by an adhesive. In this case, for a long time use, the tube 27 can be prevented from slipping off the base 26. The adhesive can use an insulating material, which has no contribution to the resistance of the entire tube, to coat a very thin film between the tube and the base. In addition, a conductive adhesive can be also used.

Figure 6A:
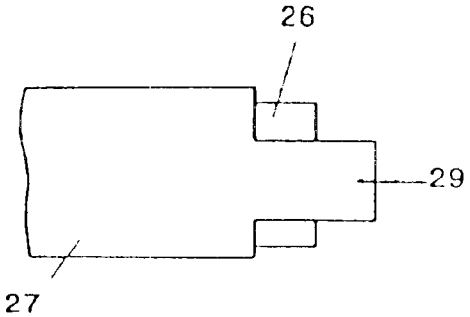
FIGS. 6A~6D are plan views showing various examples for forming a tap on the tube.
Figure 6C:
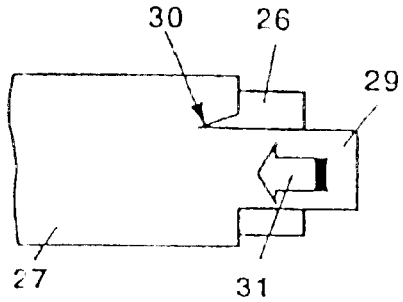
Figure 6B:
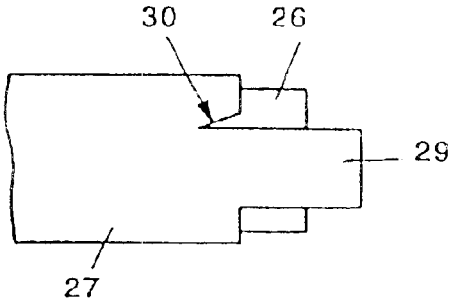
Figure 6D:
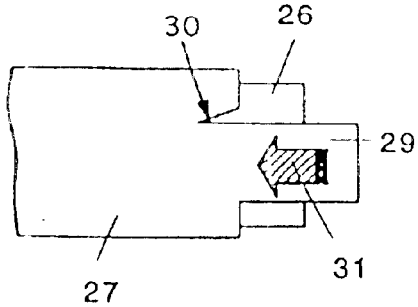

When not using the conductive adhesive or using an adhesive with good mold releasing property, the tube 27, i.e., the resistant layer, can be easily stripped off. Therefore, when any defection of the resistant layer (the tube 27) occurs due to any possible reasons, the tube 27 can be stripped off to cover a new tube over the base 26, so that the recycle property is very good. As shown in FIG. 6A, by forming a tab 29 on the tube 27, the tab 29 can be picked with the fingers and the tube 27 can be easily stripped off As shown in FIG. 6B, by cutting out a gap 30 at a corner between the tube 27 and the tab 29, stripping off the tube 27 can become easier. As shown in FIG. 6C, if an arrow 31 is marked on the tab 29, the stripping direction can be specified. Therefore, a direction where the tube 27 can be more easily stripped off can be shown to the user or service person. In FIG. 6D, if the arrow 31 on the tab 29 is colored, the arrow 31 can be easily recognized to the human eyes. The arrow 31's color can be opposite to the tube (the resistant layer) 27's color.

Figure 7:
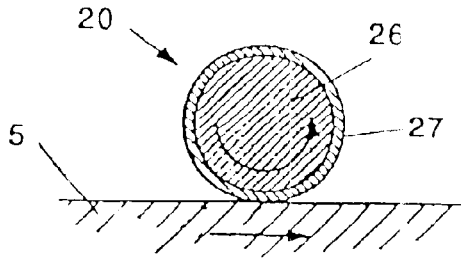
FIG. 7 is an exemplary cross-sectional view of the base being formed in a cylindrical shape.
Figure 8:
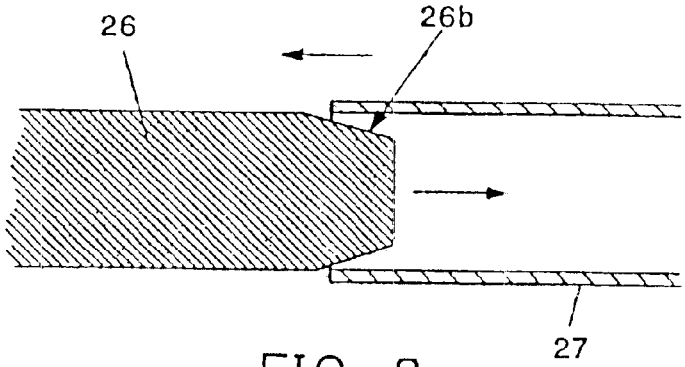
FIG. 8 an exemplary cross-sectional view of the taper formed on the end of the base.
Figure 9A:
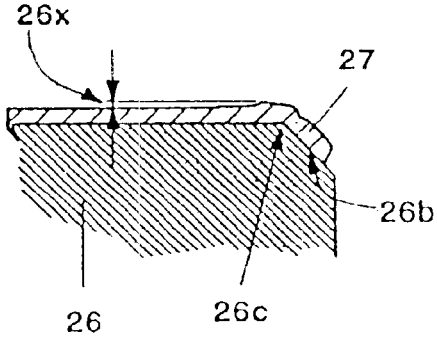
FIGS. 9A and 9B are cross-sectional views for describing the shape of the taper formed on the base's end.
Figure 9B:
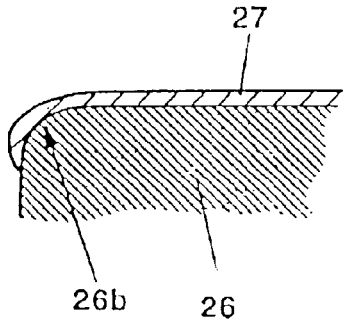

In FIG. 7, the base 26 is a cylindrical shape and rotates accompanying the photoreceptor 5. It is difficult to damage the roller 6 and its life time can be increased. In FIG. 8, by forming taper-shaped portions 26*b* on the base 26 at the ends of the image forming section 23, the tube 27 hanging on the base 26 can be prevented when the tube 27 is covered over the base 26. As shown in FIG. 9A, if no taper-shaped portions 26*b* are formed or the formed taper-shaped portions 26 have a large slope, the tube 27 is humped at the boundary 26*c* between the taper-shaped portion 26*b* and a portion near the base 26's central side, and therefore, a step 26*x* is formed. By making the taper portion to have a gentle (small) slope, or to have a gentle curve that is convex outwards, the hump of the tube 27 can be prevented. Referring to FIG. 9B, the shape of the taper-shaped portion 26*b* can have a curve whose profile between the taper-shaped portion 26*b* and a portion near the base 26's central side is convex outwards. This curve shape does not protrude from the outer circumference of the non taper portion of the central part of the base 26.

Figure 10:
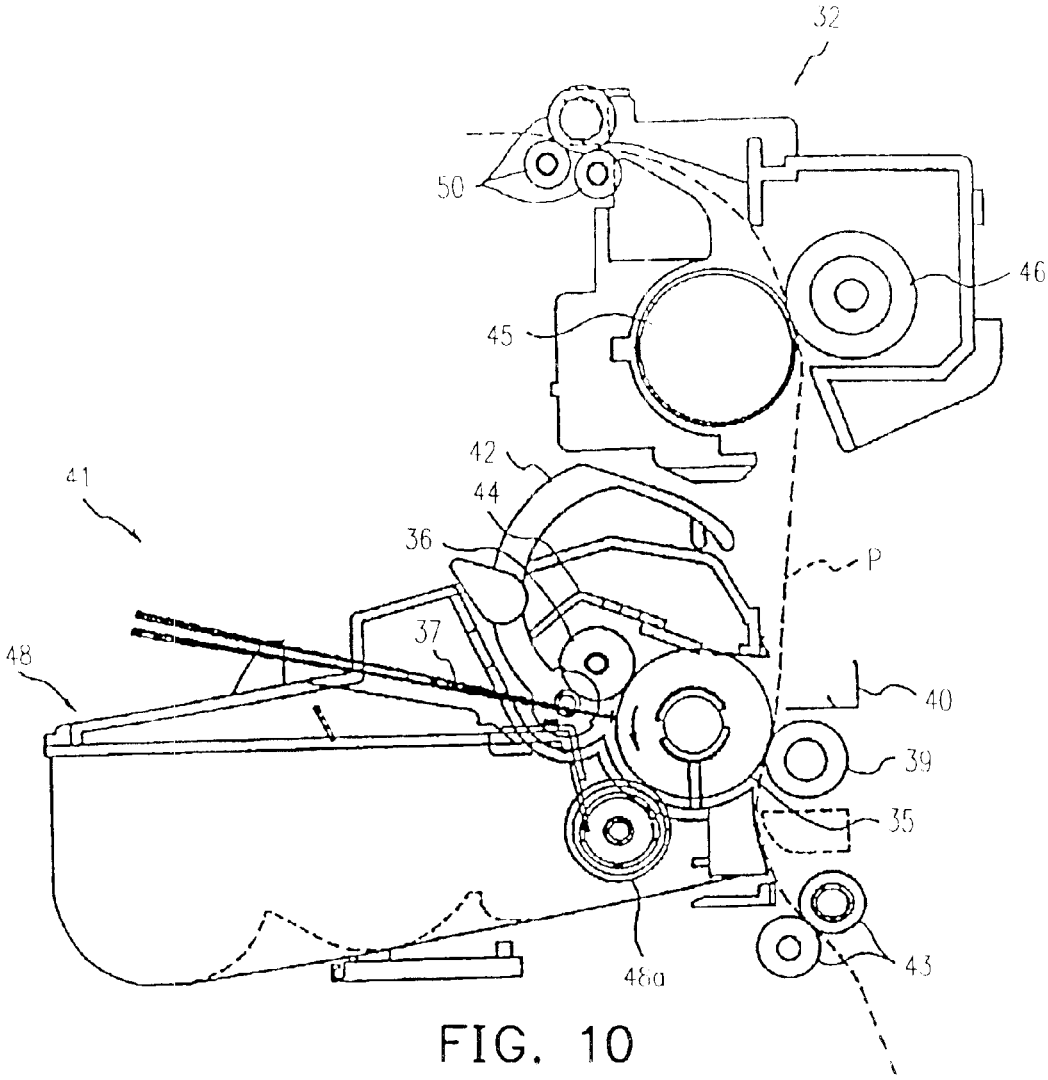
FIG. 10 shows a structure of an exemplary main portion (image forming unit) suitable for an image forming device according to the present invention.

FIG. 10 shows another structure of an exemplary main portion (image forming unit) suitable for an image forming device according to the present invention. The image forming unit is composed of a process unit 31 and a fixing device 32. The process unit 31 comprises a photoreceptor 35, a charging roller 36, an exposure device 37, a developing device 38, a transfer roller 39, a discharging pin 40, a cleaning blade 41, a photoreceptor shutter 42, and a resist roller pair 43. The photoreceptor 35 has a drum shape and is driven to rotate along the arrow direction. The charging roller 36 is in contact with the photoreceptor 35's surface and rotates with the photoreceptor 35, so as to charge with the same charge that the photoreceptor 35 has in a contact-charging manner. The exposure device 37 is used for irradiating an optical image information onto a charged region of the photoreceptor 35 to form an electrostatic latent image. The developing device 38 is used for providing toner through a developing roller 38*a* onto the electrostatic latent image to form a toner image, and then develop. The transfer roller 39 is used for transferring the toner image on the photoreceptor 35 to a transfer paper. The discharging pin 40 removes the residual charges on the photoreceptor 35 after the transfer process, and the cleaning blade 41 is used for removing the toner etc., stuck on the photoreceptor 35's surface. The resist roller pair 43 is used for providing the transfer paper P to the transfer position. The fixing device 32 comprises a heating roller 45 and a pressure roller 46. A discharge roller 50 is used for discharging the transfer paper P. In addition, since the electronic photographic process is a well-known art, its detailed description is omitted.

Figure 11:
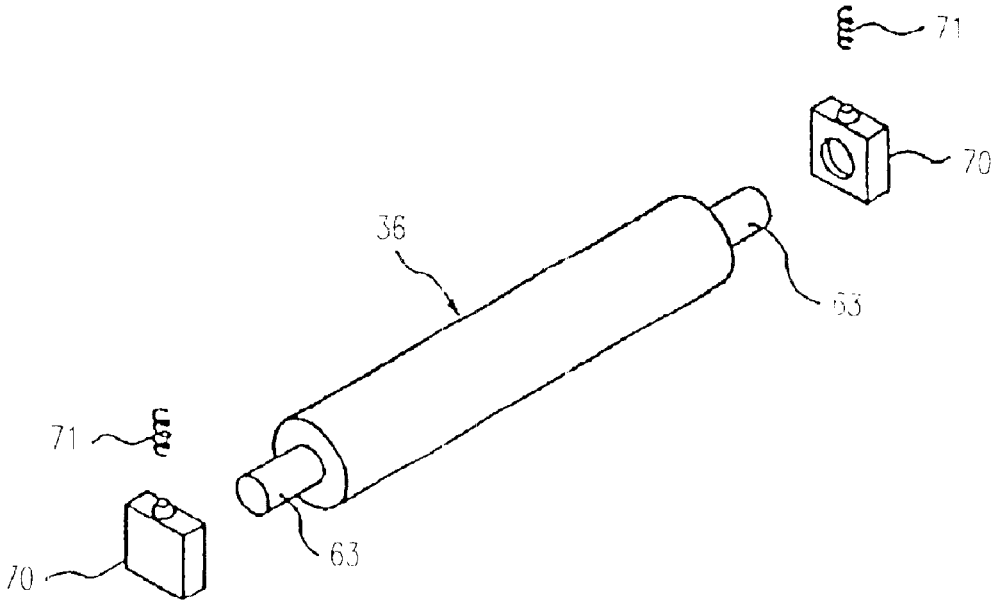
FIG. 11 is an exploded view showing a supporting structure of a charging roller according to one preferred embodiment of the invention.
Figure 12:
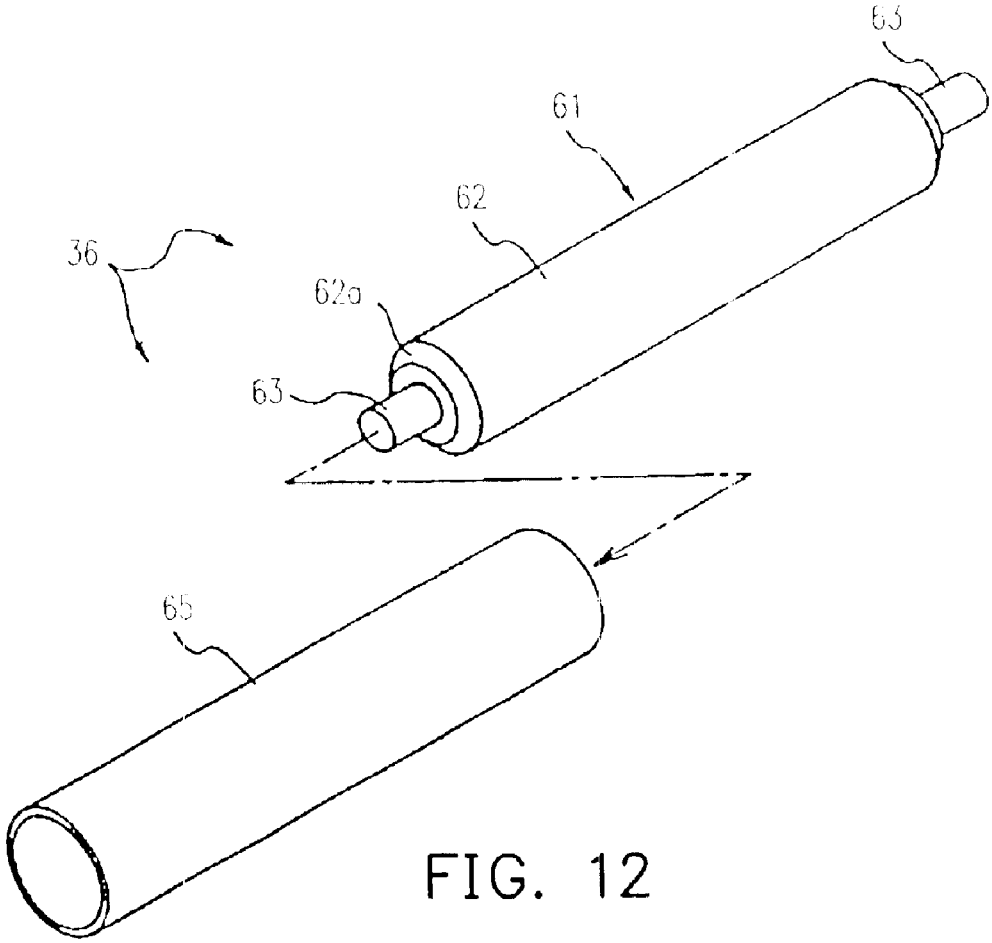
FIG. 12 is an exploded view showing the structure of the charging roller.

FIG. 11 is an exploded view showing a supporting structure of a charging roller according to one preferred embodiment of the invention. FIG. 12 is an exploded view showing the structure of the charging roller 36. A tube-shaped resistant layer 66 made by pushing out or drawing is covered on a roller-shaped base 61 made of a good conductor (such as stainless steel), and then by heating and contracting, a charging roller 36 is formed. A voltage is applied to the base 61 for charging.

As shown in FIG. 12, the charging roller 36's shaft 63, which is protruded from two ends of a large diameter portion 62 along its axial direction, is supported by bearings 70 (also see FIG. 4), and the charging roller 36 is pressed by a spring 71 with a preset pressure to be in contact with the photoreceptor 35. As the photoreceptor 35 rotates, the charging roller 36 is driven due to a frictional force at a contact portion, i.e., an accompanying rotation. The charging roller 36's press contact force against the photoreceptor 35 is set the smaller the better within a range where the accompanying rotation can occur. The reason is that if the press pressure of the spring 71 is too strong, the pressures against the two ends of the shaft 63 are unevenly distributed. Therefore, the charging roller 36's central portion in the axial direction is warped to a direction deviating from the photoreceptor 35, and poor electrification occurs easily.

The charging roller 36 is formed by covering the tube-shaped resistant layer 66 made by pushing out or drawing (FIG. 12) on the larger diameter portion 62 of the roller-shaped base 61 made of good conductor (such as stainless steel), and then by heating to heat and contract. As shown in FIG. 12, taper portions 62*a* are formed on the two ends of the larger diameter portion 62 to prevent hooking when covering the tube-shaped resistant layer 65, so that the workability can be improved.

The material for the tube-shaped resistant layer 65 can be nylon, and perfluoroaloxy (PFA) in which the carbon black (as a conductive material) is mixed and dispersed. Samples are made by varying the thickness and the surface resistance of the resistant layer 65 to verify the image charging quality. The experimental result using the nylon and the PFA is shown in FIG. 13.

During the entire experiments in FIG. 13, the common conditions are as follows. The conductive base is made of stainless steel (Japanese Industrial Standard type SUS, having a diameter of 14 mm at the center and 8 mm at the end), the power source has a voltage of DC -700V and an AC frequency of 1 kHz, and the press force of the roller is 200 gf (single side)×2 (both ends). In FIG. 13, the symbol "x"indicates that poor electrification occurs, and the symbol "o"indicates that poor electrification does not occur.

As the AC bias applied to the charging roller 36 becomes larger, discharge products stuck onto the photoreceptor 35

(as an electrified object) are increased much more. Under this influence, it is very clear that image deflections will occur. Empirically, it is preferable to set the AC bias equal to or below about 1.4 mA. In addition, if an output accuracy of the bias supply source to the charging roller 36 can be roughly designed without creating an abnormal image, a wider AC current range is preferable. According to the result shown in FIG. 13, it is not preferable that the surface resistance is $1\times10^{1}$ (Ω/□) or $1\times10^{20}$ (Ω/□) because poor electrification occurs if the AC current is not large. In addition, at a range where the surface resistance is from $1\times10^{3}$ (Ω/□) to $1\times10^{15}$ (Ω/□), a larger AC current is required as the thickness becomes larger. For a surface resistance of $1\times10^{15}$ (Ω/□), it is clear that the AC current has to be above 1.2 mA if the thickness exceeds 0.7 mm. As a result, a good electrification can be obtained by setting the surface resistance between $1\times10^{3}$ (Ω/□) and $1\times10^{15}$ (Ω/□) and setting the thickness below 0.7 mm.

According to the invention, the bias applied to the charging roller 36 comprises an AC bias and a DC bias. In comparison with when only a DC bias is applied, the uneven electrification on the charging roller 36 can be significantly reduced, so that the photoreceptor 35 can be uniformly charged.

In this embodiment, the resistant layer is formed by a thin film tube 65. By using this structure, because the tube can follow the metal shaft 62's shape that has a large dimensional accuracy, a conventional grinding process for obtaining a dimensional accuracy can be saved, so that a very cheap conductive roller can be provided. Furthermore, in this embodiment, the nylon and the PFA are used as the tube material, but the resistant stability between the nylon and the rod is excellent. Moreover, there is no problem with contamination of the photoreceptor, i.e., the electrified body.

On the other hand, regarding the PFA, foreign matter is difficult to stick on its surface in comparison with the nylon, and therefore, even though being used for a long time, the increase of the charging roller's resistance caused by the sticking of foreign matter does not occur. Furthermore, not only a stable property can be achieved, but also a mechanism for cleaning the charging roller's surface is not required. Therefore, the device cost can be reduced.

In addition, the material for the tube-shaped resistant layer 65 is the nylon and the PFA in which the carbon black (as a conductive material) is mixed and dispersed. However, other ionic conductive materials can be also used without any problem.

When the resistant layer made of the thin film tube 65 is fixed on the conductive base 62 by the thermal contraction, gaps can be formed on the thin film tube 65 by a cutter, etc., and the thin film tube 65 can be easily stripped off, so that the conductive base can be reused to achieve a low cost concern.

The thin film tube 65 is fixed to the large diameter portion 62 by a thermal contracting force. However, the thin film tube 65 can be also fixed to the large diameter portion 62 by an adhesive. In this case, even though for long time use, the tube can be prevented from slipping off. The adhesive can use an insulating material, which has no contribution to the resistance of the entire tube, to coat a very thin film between the tube and the base. In addition, a conductive adhesive can be also used.

As shown in FIG. 10 and FIG. 2, the charging roller can form a portion of the process cartridge. In this way, because the charging roller, which has a higher cost percentage, in the process cartridge is provided with a cheaper one, so that a cheaper process cartridge can be also provided.

According to one embodiment of the invention, a conductive unit, used for an image forming device, comprises a conductive base, and a single-layered resistant layer covers a surface of the conductive base. The conductive unit is in contact with an electrified body, and by applying a voltage to the conductive base, a charging process is performed in a contact charging manner. Furthermore, the single-layered resistant layer has a thickness equal to or below 0.7 mm, and has a surface resistance between $1\times10^{3}$ (Ω/□) and $1\times10^{15}$ (Ω/□). Therefore, a conductive roller can be made with a very simple structure of the single-layered resistant layer surrounding the core metal, so that a cheap conductive roller can be provided.

In summary, according to one embodiment of the invention, the charging unit comprises a base, whose surface is a good conductor; and a resistant layer, covering over the base. Because of the simple structure, the charging unit is cheap and has a high dimensional accuracy.

Since the resistant layer can be a multi-layered structure, the charging unit further possesses a voltage endurance in addition to the above effects. Furthermore, because the resistant layer is covered over the base after the resistant layer is formed in a tube shape with a preset thickness, the resistant layer is formed in a tube shape and therefore, the thickness can be uniform. Because the resistant layer is thinned and able to follow the dimensional accuracy of the base and then covers over the base, the grinding process is not required. Therefore, a cheap conductive unit with dimensional accuracy can be made. Because the conductive unit's simple structure is formed only by covering the tube over the base, only the covered tube is required to be replaced when recycling, so that the recycling property is excellent.

In addition, the tube-shaped resistant layer is fixed onto the base by a thermal contraction, the adhesive is not required, so that the conductive unit can be made in a cheap manner. Furthermore, an adhesive can be used between the resistant layer and the base, or between layers of the resistant layer. Therefore, for a long time use, the shift between layers of the resistant layer and the shift between the resistant layer and the base can be prevented.

Furthermore, since the surface resistance of the resistant layer is equal to or below $1\times10^{15}$ Ω/□, charges can be better provided to the electrified body (the photoreceptor).

Moreover, as described above, because the base material of the resistant layer is nylon, the electrified body (the photoreceptor) can be uniformly charged. Additionally, the base material of the resistant layer comprises a low friction material, so that for long time use, the resistance variation due to the stuck contaminator can be reduced. When the resistant layer can be made of PFA the life time is increased due to the PFA's low friction, and a uniform and thin resistant layer can be formed due to its excellent workability.

Since a tab is formed on a portion of the resistant layer, the resistant layer can be easily stripped off. Moreover, a gap is further cut out to form in vicinity of the tab, stripping off the resistant layer becomes easier. Because a mark for indicating a stripping direction of the tab can be formed on the tab and the mark is colored different from the resistant layer, the correct direction can be recognized to the human eyes when stripping off the resistant layer. In addition, the base is hollow, and therefore, the conductive unit can be lighter.

As described above, because a portion of the charging unit for charging is a cylindrical shape, it is difficult to damage the electrified body (the photoreceptor) and difficult to waste the electrified body and the charging unit. Therefore, the electrified body and the charging unit can have a long lifetime. In addition, because the conductive unit is rotated accompanying the electrified body, no motor or gears are required. Therefore, the device using the charging unit can become cheaper.

Since a taper-shaped portion is formed on at least one end of the base, the workability during covering the resistant layer can be improved. In addition, because the taper-shaped portion is a curve whose profile between the taper-shaped portion and a portion near the base central side is convex outwards, the hump of the resistant layer created at the end of the base can be reduced, so that a minor gap between the charging unit and the electrified body can be kept.

According to another embodiment, because the charging device uses the charging unit as described above and an AC and a DC source is overlapped to provide to the charging unit, the electrified body can be uniformly charged. In addition, according to still another embodiment, since the charging device uses the charging unit as described above and a DC source is provided to the charging unit, it is good for the environment in comparison with overlapping the AC bias and the DC bias.

According to one embodiment of the invention, because the process cartridge uses the built-in charging unit as described above, the process cartridge can be cheap and have an excellent recycle property.

According to one embodiment of the invention, because the image forming device has the charging unit, the charging device, or the process cartridge therein, the image forming device can be cheap and have an excellent recycle property.

According to one embodiment of the invention, the conductive unit comprises a conductive base, and a single-layered resistant layer, covering on a surface of the conductive base. The conductive unit is in contact with an electrified body, and by applying a voltage to the conductive base, a charging process is performed in a contact charging manner. The single-layered resistant layer has a thickness equal to or below 0.7 mm, and has a surface resistance between $1\times10^{3}$ (Ω/□) and $1\times^{15}$ (Ω/□). Therefore, the conductive roller can be made with a very simple structure of the single-layered resistant layer surrounding the core metal, and a cheap conductive roller can be provided.

The tube covers the conductive base after the single-layered resistant layer is made of a tube with a preset thickness. Therefore, the grinding process for the resistant layer can be omitted so as to provide a cheap conductive unit and be able to reproduce the conductive base. Namely, by forming the resistant layer in a tube shape, the thickness can be uniform. By thinning the resistant layer, the resistant layer follows the base's dimension to cover thereon, and the dimensional accuracy can be made without the grinding process. In addition, removing the resistant layer can be improved and the recycling property of the conductive base can be improved.

In addition, the single-layered resistant layer made of the tube is fixed onto the conductive base by a thermal contraction. Therefore, a cheap conductive unit can be provided and the conductive base can be reproduced. Namely, because the tube-shaped resistant layer is fixed to the base by thermal contraction, the adhesive is not required and a cheap conductive unit can be provided. In addition, because the adhesive is not used, removing the resistant layer can be improved and the recycling property of the conductive base can be improved.

In addition, according to another aspect of the invention, the conductive base and the resistant layer can be also fixed by an adhesive. In this way, by fixing the conductive base and the resistant layer with the adhesive, the shift between the conductive base and the resistant layer for a long time use can be exactly avoided, and the durability can be further improved.

The resistant layer is made of nylon for providing charges. Therefore, it can provide a product whose thickness and resistance of thin film tube are stable. Alternatively, the resistant layer is made of PFA for providing charges. Therefore, it can provide a product whose resistance variation due to the stuck contaminator for a long time use.

In addition, a taper portion is formed at at least one end of the conductive base covered by the tube that forms the single-layered resistant layer. Because the end of the base is thinner when covering the tube, the workability can be improved.

According to one embodiment of the invention, the charging roller can form a portion of the process cartridge. In this way, because the charging roller, which weights as a higher cost percentage, in the process cartridge is provided with a cheaper one, so that a cheaper process cartridge can be also provided.

According to one embodiment of the invention, the bias applied to the conductive unit includes an AC bias and a DC bias. Therefore, in comparison with only applying the DC bias, the charged unevenness of the electrified body is very small so that the electrified body can be uniformly charged.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A charging unit, used for an image forming device, comprising:

a conductive base as an innermost portion of the charging unit; and, a single-layered resistant layer, an inner surface of said resistant layer in direct contact with an outer surface of the conductive base, an outer surface of said resistant layer in contact with an electrified body, and by applying a voltage to the conductive base, a charging process is performed in a contact charging manner, and wherein the single-layered resistant layer has a thickness equal or below 0.7 mm, and has a surface resistance between $1\times10^{3}$ (Ω/□) and $1\times10^{15}$ (Ω/□).

2. The charging unit of claim 1, wherein the single-layered resistant layer is made of a tube with a preset thickness, and the tube covers the conductive base.

3. The charging unit of claim 2, wherein the single-layered resistant layer made of the tube is fixed onto the conductive base by a thermal contraction.

4. The charging unit of claim 3, wherein a taper portion is formed at least at one end of the conductive base covered by the tube that forms the single-layered resistant layer.

5. An image forming device, comprising at least:

a process cartridge, having a charging unit therein, wherein the charging unit further comprises a conductive base as an innermost portion of the charging unit, and a single-layered resistant layer, an inner surface of said resistant layer in direct contact with an outer surface of the conductive base, an outer surface of said resistant layer in contact with an electrified body, and by applying a voltage to a conductive base, a charging process is performed in a contact charging manner, and wherein the single-layered resistant layer has a thickness equal or below 0.7 mm, and has a surface resistance between $1\times10^3$ (Ω/□) and $1\times10^{15}$ (Ω/□).

6. The image forming device of claim 5, wherein the single-layered resistant layer is made of a tube with a preset thickness, and the tube covers the conductive base.

7. The image forming device of claim 6, wherein the single-layered resistant layer made of the tube is fixed onto the conductive base by a thermal contraction.

8. The image forming device of claim 7, wherein a taper portion is formed at least one end of the conductive base covered by the tube that forms the single-layered resistant layer.

9. An image forming device, comprising:

a process cartridge, and, a charging unit, installed inside said process cartridge, wherein the charging unit further comprises a conductive base as an innermost portion of the charging unit, and a single-layered resistant layer, an inner surface of said resistant layer in direct contact with an outer surface of the conductive base, an outer surface of said resistant layer in contact with an electrified body, and by applying a voltage to a conductive base, a charging process is performed in a contact charging manner, and wherein the single-layered resistant layer has a thickness equal or below 0.7 mm, and has a surface resistance between $1\times10^3$ (Ω/□) and $1\times10^{15}$ (Ω/□), and wherein a bias applied to the charging unit includes an AC bias and a DC bias.

10. The image forming device of claim 9, wherein the single-layered resistant layer is made of a tube with a preset thickness, and the tube covers the conductive base.

11. The image forming device of claim 10, wherein the single-layered resistant layer made of the tube is fixed onto the conductive base by a thermal contraction.

12. The image forming device of claim 11, wherein a taper portion is formed at at least one end of the conductive base covered by the tube that forms the single-layered resistant layer.

13. A charging unit, used for an image forming device, comprising:

a base as an innermost portion of the charging unit, whose surface is a good conductor; and a resistant member, an inner surface of said resistant member in direct contact with an outer surface of the base, wherein an outer surface of said resistant member keeps a sufficient small gap with an electrified body, and said outer surface of said resistant member is operatively arranged to charge a surface of the electrified body uniformly due to a discharge at the gap between said outer surface of said resistive member and said surface of said electrified body, said resistant member comprising a low friction material, said resistant member further comprising nylon.

14. The charging unit of claim 13, wherein the resistant member is a multi-layered structure.

15. The charging unit of claim 13, wherein the resistant member is covered over the base after the resistant member is formed in a tube shape with a preset thickness.

16. The charging unit of claim 15, wherein the tube-shaped resistant member is formed onto the base by a thermal contraction.

17. The charging unit of claim 14, wherein an adhesive is used between the resistant member and the base, or between layers of the resistant member.

18. The charging unit of claim 13, wherein a surface resistance of the resistant member is equal to or below $10^{15}$ (Ω/□).

19. The charging unit of claim 13, wherein the resistant member is made of PFA.

20. The charging unit of claim 13, wherein a tab is formed on a portion of the resistant member.

21. The charging unit of claim 20, wherein a gap is cut out to form in vicinity of the tab.

22. The charging unit of claim 20, wherein a mark for indicating a stripping direction of the tab is formed on the tab.

23. The charging unit of claim 22, wherein the mark is colored different from the resistant member.

24. The charging unit of claim 13, wherein the base is hollow.

25. The charging unit of claim 13, wherein a portion of the charging unit for charging is a cylindrical shape, and rotates accompanying with the electrified body.

26. The charging unit of claim 15, wherein a taper-shaped portion is formed on at least one end of the base.

27. The charging unit of claim 26, wherein the taper-shaped portion is a curve whose profile between the taper-shaped portion and a portion near a base central side is convex outwards.

28. A charging device, using the charging unit of any one of claims 13 to 18 or 19 to 27, wherein an AC and a DC source is overlapped to provide power to the charging unit.

29. A charging device, using the charging unit of any one of claims 13 to 18 or 19 to 27, wherein a DC source is provided to the charging unit.

30. A process cartridge using the charging unit of any one of claims 13 to 18 or 19 to 27, that is built in the process cartridge.

31. An image forming device having the charging unit of any one of claims 13 to 18 or 19 to 27 therein.

32. A process cartridge using the charging device of claim 28 that is built in the process cartridge.

33. A process cartridge using the charging device of claim 29 that is built in the process cartridge.

34. An image forming device having the charging device of claim 28 therein.

35. An image forming device having the charging device of claim 29 therein.

36. An image forming device having the process cartridge of claim 30 therein.

* * * * *